US010161047B2

(12) United States Patent
Miura et al.

(10) Patent No.: US 10,161,047 B2
(45) Date of Patent: Dec. 25, 2018

(54) METHOD FOR TREATING SURFACE OF ZINC-ALUMINUM-MAGNESIUM ALLOY-PLATED STEEL SHEET

(71) Applicants: NIPPON PAINT SURF CHEMICALS CO., LTD., Shinagawa-ku (JP); NISSHIN STEEL CO., LTD., Chiyoda-ku (JP)

(72) Inventors: Yusuke Miura, Yokohama (JP); Shintaro Nakamura, Yokohama (JP); Tadashi Nakano, Kaizuka (JP); Masaya Yamamoto, Ichikawa (JP); Hirofumi Taketsu, Suginami-ku (JP)

(73) Assignees: NIPPON PAINT SURF CHEMICALS CO., LTD., Shinagawa-ku (JP); NISSHIN STEEL CO., LTD., Chiyoda-ku (JP)

( * ) Notice: Subject to any disclaimer, the term of this patent is extended or adjusted under 35 U.S.C. 154(b) by 27 days.

(21) Appl. No.: 15/039,512

(22) PCT Filed: Nov. 28, 2014

(86) PCT No.: PCT/JP2014/081634

§ 371 (c)(1),
(2) Date: May 26, 2016

(87) PCT Pub. No.: WO2015/080268

PCT Pub. Date: Jun. 4, 2015

(65) Prior Publication Data

US 2017/0211188 A1 Jul. 27, 2017

(30) Foreign Application Priority Data

Nov. 29, 2013 (JP) ..... 2013-247677
Nov. 6, 2014 (JP) ..... 2014-226140

(51) Int. Cl.

| | |
|---|---|
| ***C23C 22/44*** | (2006.01) |
| ***C23C 2/06*** | (2006.01) |
| ***C22C 18/00*** | (2006.01) |
| ***C22C 18/04*** | (2006.01) |
| ***C23C 2/26*** | (2006.01) |

(52) U.S. Cl.
CPC ..... *C23C 22/44* (2013.01); *C22C 18/00* (2013.01); *C22C 18/04* (2013.01); *C23C 2/06* (2013.01); *C23C 2/26* (2013.01)

(58) Field of Classification Search
None
See application file for complete search history.

(56) References Cited

U.S. PATENT DOCUMENTS

| | | | | |
|---|---|---|---|---|
| 3,505,043 | A | 4/1970 | Lee et al. | |
| 2003/0015258 | A1* | 1/2003 | Nishimura | C09D 133/066 148/247 |
| 2003/0213533 | A1* | 11/2003 | Sako | C08L 61/14 148/243 |
| 2009/0087674 | A1* | 4/2009 | Slawikowski | C09D 5/004 428/472 |
| 2009/0110921 | A1 | 4/2009 | Kaneto et al. | |
| 2011/0253691 | A1* | 10/2011 | Kodama | C22C 18/04 219/137 R |
| 2015/0107722 | A1 | 4/2015 | Nakano et al. | |

FOREIGN PATENT DOCUMENTS

| | | | |
|---|---|---|---|
| CN | 1386805 | A | 12/2002 |
| CN | 1474857 | A | 2/2004 |
| CN | 1827725 | A | 9/2006 |
| CN | 101815761 | A | 8/2010 |
| EP | 1 918 419 | A1 | 5/2008 |
| JP | 2000-239854 | A | 9/2000 |
| JP | 2004-183015 | A | 7/2004 |
| JP | 2009-84516 | A | 4/2009 |
| JP | 2009-287079 | A | 12/2009 |
| JP | 2012-62565 | A | 3/2012 |
| JP | 2012-212511 | A | 11/2012 |
| JP | 2012-212512 | A | 11/2012 |
| JP | 2012-224889 | A | 11/2012 |
| JP | 2013-23705 | A | 2/2013 |
| WO | WO 2013/161269 | A1 | 10/2013 |

OTHER PUBLICATIONS

International Search Report dated Feb. 24, 2015 in PCT/JP2014/081634 Filed Nov. 28, 2014.
Extended European Search Report dated Jul. 14, 2017 in Patent Application No. 14866659.7.
Combined Office Action and Search Report dated Feb. 5, 2018 in Chinese Patent Application No. 201480065135.4 (with English translation of categories of cited documents) citing references AO—AR therein, 9 pages.

* cited by examiner

*Primary Examiner* — Shamim Ahmed
*Assistant Examiner* — Bradford M Gates
(74) *Attorney, Agent, or Firm* — Oblon, McClelland, Maier & Neustadt, L.L.P.

(57) ABSTRACT

Provided is a method for obtaining a chemical conversion coating-treated zinc-aluminum-magnesium alloy-plated steel sheet having extremely excellent in corrosion resistance and adhesiveness to a resin coating film. The method is for treating the surface of a zinc-aluminum-magnesium alloy-plated steel sheet with a metal surface treatment agent, in which the metal surface treatment agent contains a compound (A) having a zirconyl ($[Zr{=}O]^{2+}$) structure, a vanadium compound (B), a titanium fluorocomplex compound (C), an organic phosphorus compound (Da) containing a phosphoric acid group and/or a phosphonic acid group, an inorganic phosphorus compound (Db), a specific aqueous acrylic resin (E), and an oxazoline group-containing polymer (F) as a curing agent, each in a predetermined amount, and the pH of the metal surface treatment agent is 3 to 6.

6 Claims, No Drawings

METHOD FOR TREATING SURFACE OF ZINC-ALUMINUM-MAGNESIUM ALLOY-PLATED STEEL SHEET

TECHNICAL FIELD

The present invention relates to a surface treatment method for a zinc-aluminum-magnesium alloy-plated steel sheet with a chromium-free metal surface treatment agent and to a chemical conversion coating-treated zinc-aluminum-magnesium alloy-plated steel sheet obtained according to the surface treatment method.

BACKGROUND ART

A metal material such as a zinc-plated steel sheet material, an aluminum material or the like is oxidized and corroded by oxygen and moisture in air, and by ions contained in moisture, etc. As a method for preventing such corrosion, there is a method for forming a chromate coating film through contact of a metal surface with a chromium-containing treating liquid such as chromium chromate, chromium phosphate or the like. The coating film formed according to the chromate treatment has excellent corrosion resistance and coating film adhesiveness, but the treatment liquid contains harmful hexavalent chromium and is problematic in that wastewater treatment takes a lot of trouble and cost. In addition, the coating film formed according to the treatment also contains hexavalent chromium, and therefore environmental and safety problems are pointed out.

Accordingly, aqueous liquid compositions for metal surface treatment and chemical conversion treatment agents not containing a chromate (chromium-free) but having corrosion resistance on the same level as that of already-existing chromate chemical conversion coating films have been proposed (for example, see PTLs 1, 2).

The metal surface treatment agent in PTL 1 is a chromium-free metal surface treatment agent containing a vanadium compound (A), a metal compound (B) containing a metal selected from cobalt, nickel, zinc, magnesium, aluminium, calcium, strontium, barium and lithium, and optionally a metal compound (C) containing zirconium, titanium, molybdenum, tungsten, manganese and cerium, which can impart excellent corrosion resistance, alkali resistance and interlayer adhesiveness to a metal material.

The metal surface treatment agent in PTL 2 is a metal surface treatment agent containing one or more Group-4 transition metal compounds (a) selected from a Zr compound capable of releasing zirconyl ion ($ZrO^{2+}$) in an aqueous solution and a Ti compound capable of releasing a titanyl ion ($TiO^{2+}$) in an aqueous solution, and an organic compound (b) having two or more of at least one functional group selected from a hydroxyl group, a carboxyl group, a phosphonic acid group, a phosphoric acid group and a sulfonic acid group, in one and the same molecule, and is a chromium-free metal surface treatment agent capable of imparting high adhesiveness in such a level that, even when a resin coating film formed after chemical conversion coating film formation is processed in a severe forming process of deep-drawing or the like, the resin coating film is not peeled off.

Both the metal surface treatment agents in PTLs 1 and 2 may contain an aqueous resin that may be soluble in water or dispersible in water.

On the other hand, since the proposal in PTL 3, it is known that a molten zinc-aluminum-magnesium plated steel sheet using a plating bath containing suitable amounts of aluminum and magnesium in zinc is excellent in corrosion resistance.

CITATION LIST

Patent Literature

PTL 1: JP-A 2004-183015
PTL 2: JP-A 2013-23705
PTL 3: U.S. Pat. No. 3,505,043

SUMMARY OF INVENTION

Technical Problem

However, the metal surface treatment agents in PTLs 1 and 2 are not always sufficient in point of corrosion resistance and adhesiveness in some subjects to be treated and uses.

Given the situation, an object of the present invention is to provide a method for obtaining a chemical conversion coating-treated zinc-aluminum-magnesium alloy-plated steel sheet extremely excellent in corrosion resistance and adhesiveness to a resin coating film, by treating the surface of a zinc-aluminum-magnesium alloy-plated steel sheet having good corrosion resistance, with a chromium-free metal surface treatment agent excellent in corrosion resistance and capable of forming a coating film having high adhesiveness between the plated steel sheet and the resin coating film such as a coating layer, a laminate film or the like.

Solution to Problem

For the purpose of attaining the above-mentioned objects, the present inventors have made assiduous studies and, as a result, have found that, in treating the surface of a zinc-aluminum-magnesium alloy-plated steel sheet where the plating layer contains Al: 1.0 to 10 mass % and Mg: 1.0 to 10 mass % with the balance of Zn and inevitable impurities with a compound having a zirconyl ($[Zr{=}O]^{2+}$) structure, a vanadium compound and a specific metal fluorocomplex compound to etch the metal surface to thereby form a corrosion-resistant coating film, when the surface is treated with a metal surface treatment agent containing both an organic phosphorus compound and an inorganic phosphorus compound and further containing specific amounts of a high acid-value aqueous acrylic resin and an oxazoline-containing polymer, in which the ratio of the inorganic compound to the organic compound is controlled to fall within a specific range so that the agent could fall within a specific pH range, a chemical conversion coating-treated zinc-aluminum-magnesium alloy-plated steel sheet which is extremely excellent in corrosion resistance and adhesiveness to the resin coating film, in which the coating film formed is excellent in corrosion resistance and additionally not only in adhesiveness to the plated steel sheet but also in adhesiveness to a resin film such as a coating film, a laminate film or the like, can be obtained. The present invention has been completed on the basis of these findings. Specifically, the present invention is as follows.

[1] A method for treating the surface of a zinc-aluminum-magnesium alloy-plated steel sheet with a metal surface treatment agent, comprising:

a step of forming a zinc-aluminum-magnesium alloy-plating layer on the surface of a steel sheet, and a step of treating the surface of the plating layer with a metal surface treatment agent subsequently after the step of forming the plating layer, wherein the zinc-aluminum-magnesium alloy plating layer is a plating layer containing Al: 1.0 to 10 mass % and Mg: 1.0 to 10 mass % with the balance of Zn and inevitable impurities, the metal surface treatment agent contains a compound (A) having a zirconyl ($[Zr{=}O]^{2+}$) structure, a vanadium compound (B), a titanium fluorocomplex compound (C), an organic phosphorus compound (Da) containing a phosphoric acid group and/or a phosphonic acid group, an inorganic phosphorus compound (Db), an aqueous acrylic resin (E), and an oxazoline group-containing polymer (F) as a curing agent, the solid fraction acid value of the aqueous acrylic resin (E) is 300 mg KOH/g or more, the content of the aqueous acrylic resin (E) relative to the metal surface treatment agent is 100 ppm to 30,000 ppm as the concentration of the resin solid content therein, the content of the oxazoline group-containing polymer (F) relative to the metal surface treatment agent is 50 ppm to 5,000 ppm as the concentration of the solid content therein, and the ratio by mass of the total mass of the compound (A) having a zirconyl ($[ZrO]^{2+}$) structure, the vanadium compound (B) and the titanium fluorocomplex compound (C), in terms of the metal elements therein, to the solid content of the aqueous acrylic resin (E) and the oxazoline group-containing polymer (F), namely, (A+B+C)/(E+F) is 10/1 to 1/1, and the pH of the metal surface treatment agent is 3 to 6.

[2] The method for treating the surface of a zinc-aluminum-magnesium alloy-plated steel sheet with a metal surface treatment agent according to the above [1], wherein the ratio by mass of the solid contents of the aqueous acrylic resin (E) to the oxazoline group-containing polymer (F) that is a curing agent, E/F is 20/1 to 2/3.

[3] The method for treating the surface of a zinc-aluminum-magnesium alloy-plated steel sheet with a metal surface treatment agent according to the above [1] or [2], wherein the ratio by mass of the organic phosphorus compound (Da) to the inorganic phosphorus compound (Db), Da/Db is 5/1 to 1/2, in terms of the phosphorus element therein.

[4] The method for treating the surface of a zinc-aluminum-magnesium alloy-plated steel sheet with a metal surface treatment agent according to any of the above [1] to [3], wherein the zinc-aluminum-magnesium alloy plating layer further contains one or more of Si: 0.001 to 2.0 mass %, Ti: 0.001 to 0.1 mass % and B: 0.001 to 0.045 mass %.

[5] A zinc-aluminum-magnesium alloy-plated steel sheet obtained through treatment according to the method described in any of the above [1] to [4].

Advantageous Effects of Invention

According to the present invention, there is provided a method for treating the surface of a zinc-aluminum-magnesium alloy-plated steel sheet having good corrosion resistance with a chromium-free metal surface treatment agent capable of forming an excellent coating film in corrosion resistance and having high adhesiveness between the plated steel plate and a resin coating film.

DESCRIPTION OF EMBODIMENTS

The present invention is a method for treating the surface of a zinc-aluminum-magnesium alloy-plated steel sheet (hereinafter this may be referred to as "metal material") with a specific chromium-free metal surface treatment agent (hereinafter this may be referred to as "treatment agent"), and comprises a step of forming a zinc-aluminum-magnesium alloy-plating layer on the surface of a steel sheet, and a step of treating the surface of the plating layer with a metal surface treatment agent subsequently after the step of forming the plating layer. (The surface treatment with a chromium-free metal surface treatment agent may be hereinafter referred to as "chemical conversion treatment".

The plated steel sheet in the present invention is a zinc-aluminum-magnesium alloy-plated steel sheet produced by using a molten Zn—Al—Mg plating bath. As described below, the metal surface treatment agent in the present invention contains a fluorine compound and forms a reaction layer containing Al and Mg fluorides on the surface of the plating layer of a plated steel sheet through the chemical conversion reaction, therefore enhancing more the adhesion power between the chemical conversion coating film and the surface of the plating layer.

A known method is employable for the step of forming a zinc-aluminum-magnesium alloy plating layer on the surface of a steel sheet. Preferably, the layer is formed according to a hot-dip plating method using an alloy plating bath containing 1.0 to 10 mass % of aluminum and 1.0 to 10 mass % of magnesium with the balance of Zn and inevitable impurities. For preventing the formation and growth of a $Zn_{11}Mg_2$ phase that has some negative influences on appearance and corrosion resistance, it is more desirable to add Ti, B, a Ti—B alloy or a Ti or B-containing compound to the plating bath. Regarding the amount of the metal or the compound to be added in terms of metal relative to the plating bath, preferably, Ti is 0.001 to 0.1 mass %, and B is 0.001 to 0.045 mass %. When the amount range of each Ti and B falls within the above range, it is possible to prevent formation of a $Zn_{11}Mg_2$ phase in the plating layer. Further, for improving the adhesiveness between the steel sheet and the plating layer during forming process, preferably, Si having a function of preventing the growth of an Al—Fe alloy layer in the interface between the plating layer and the steel sheet is added in an amount falling within a range of 0.001 to 2.0 mass %.

Accordingly, the zinc-aluminum-magnesium alloy plated steel sheet in the present invention is obtained by forming a zinc-aluminum-magnesium alloy plating layer on the surface of a steel sheet, and the zinc-aluminum-magnesium alloy plating layer is a plating layer containing Al: 1.0 to 10 mass % and Mg: 1.0 to 10 mass % with the balance of Zn and inevitable impurities. Preferably, the zinc-aluminum-magnesium alloy plating layer contains Zn in an amount of 80 to 98 mass %.

Preferably, the zinc-aluminum-magnesium alloy plating layer further contains one or more of Si: 0.001 to 2.0 mass %, Ti: 0.001 to 0.1 mass % and B: 0.001 to 0.045 mass %.

The metal surface treatment agent in the present invention is a chromium-free, aqueous metal surface treatment agent containing a compound (A) having a zirconyl ($[Zr{=}O]^{2+}$) structure, a vanadium compound (B), a titanium fluorocomplex compound (C), an organic phosphorus compound (Da), an inorganic phosphorus compound (Db), an aqueous acrylic resin (E), and an oxazoline group-containing polymer (F) as a curing agent, wherein the metal compounds (A), (B) and (C), the aqueous acrylic resin (E) and the oxazoline group-containing polymer (F) as a curing agent are in a specific ratio by mass.

Fluoride ions released from the titanium fluorocomplex compound (C) etch the surface of the metal material to increase the pH in the vicinity of the surface, and the anion of the titanium fluorocomplex reacts with the zirconyl ($[Zr{=}O]^{2+}$ cation derived from the zirconium compound (A) and with the metal substrate-derived metal cation released through etching to thereby deposit on the surface, therefore forming a coating film excellent in corrosion resistance and having high adhesiveness to the metal material. A coating film having improved corrosion resistance can be formed by containing the vanadium compound (B), and the corrosion resistance of the film can be improved by containing both the organic phosphorus compound (Da) and the inorganic phosphorus compound (Db).

Further, the aqueous acrylic resin (E) having a solid fraction acid value of 300 mg KOH/g or more and the oxazoline group-containing polymer (F) as a curing agent, in a specific ratio by mass relative to the metal compounds (A), (B) and (C), are contained. Therefore, the adhesiveness to the metal material, the adhesiveness to a resin coating film and the corrosion resistance can be further improved.

The zirconium compound (A) for use in the metal surface treatment agent in the present invention is a compound having a zirconyl ($[Zr{=}O]^{2+}$) structure. The zirconium compound (A) includes zirconyl ammonium carbonate, zirconyl sulfate, zirconylammonium sulfate, zirconyl nitrate, zirconylammonium nitrate, zirconyl formate, zirconyl acetate, zirconyl propionate, zirconyl butyrate, salt of oxalic acid with zirconyl ion, salt of malonic acid with zirconyl ion, salt of succinic acid with zirconyl ion, zirconium oxychloride, etc. The compound having a zirconyl ($[Zr{=}O]^{2+}$) structure improves crosslinkability in coating film formation and provides a coating film having good corrosion resistance.

The content of the zirconyl group-containing zirconium compound (A) in the treatment agent is preferably 0.01 to 10 mass %, more preferably 0.1 to 8 mass %, further more preferably 0.2 to 8 mass %, still more preferably 0.5 to 5 mass %. When the content of the zirconyl group-containing zirconium compound (A) is 0.01 mass % or more, sufficient corrosion resistance can be given, and when the content is 10 mass % or less, the coating film can have sufficient flexibility and is excellent in working adhesiveness to resin coating film.

In the metal surface treatment agent in the present invention, examples of the vanadium compound (B) include metavanadic acid and its salts, vanadium oxide, vanadium trichloride, vanadium oxytrichloride, vanadium acetylacetonate, vanadium oxyacetylacetonate, vanadyl sulfate, vanadium sulfate, vanadium nitrate, vanadium phosphate, vanadium acetate, vanadium biphosphate, vanadium alkoxide, vanadium oxyalkoxide, etc. Among these, use of compounds in which the oxidation number of vanadium is pentavalent is preferred. Specifically, metavanadic acid and its salts, vanadium oxide, vanadium oxytrichloride, vanadium alkoxide and vanadium oxyalkoxide are preferred.

The content of the vanadium compound (B) in the treatment agent is preferably 0.01 to 5 mass %, more preferably 0.1 to 3 mass %. The vanadium compound (B) of an amount of 0.01 to 5 mass % in the treatment agent can improve corrosion resistance.

The titanium fluorocomplex compound (C) for use in the metal surface treatment agent in the present invention includes fluorotitanic acid and its salts. Since the titanium fluorocomplex compound (C) contains fluorine, the metal surface may be readily etched, and therefore a coating film having an excellent corrosion resistance and having high adhesiveness to the metal material can be formed.

The content of the titanium fluorocomplex compound (C) in the treatment agent is preferably 0.01 to 10 mass %, more preferably 0.1 to 8.5 mass %, further more preferably 0.3 to 7 mass %. When the content of the titanium fluorocomplex compound (C) is 0.01 mass % or more, corrosion resistance can be given sufficiently, and when the content is 10 mass % or less, overetching can be prevented and excessive release of metal cations relative to the inorganic phosphorus compound (Db) can be prevented, and therefore excellent corrosion resistance can be given.

The metal surface treatment agent in the present invention contains both the organic phosphorus compound (Da) containing a phosphoric acid group and/or a phosphonic acid group and the inorganic phosphorus compound (Db), and therefore can more improve corrosion resistance.

The organic phosphorus compound (Da) includes phosphonic acids and their salts such as 1-hydroxyethylidene-1,1-diphosphonic acid, 2-phosphonobutane-1,2,4-tricarboxylic acid, ethylenediamine-tetramethylene phosphonic acid, aminotrimethylenephosphonic acid, phenylphosphonic acid, octylphosphonic acid, etc. These organic phosphorus compounds may be combined and used. Among these, 1-hydroxyethylidene-1,1-diphosphonic acid, 2-phosphonobutane-1,2,4-tricarboxylic acid and aminotrimethylenephosphonic acid are preferred.

The inorganic phosphorus compound (Db) includes phosphoric acid and their salts such as phosphoric acid, phosphorous acid, etc.; condensed phosphoric acids and their salts such as pyrophosphoric acid, tripolyphosphoric acid, etc. Here, the cation for forming salts of phosphoric acids and salts of condensed phosphoric acids may be any one capable of forming a salt that is easily soluble in water to give an aqueous solution capable of releasing a phosphate ion, and includes sodium, potassium, ammonium, etc. These inorganic phosphorus compounds may be combined and used. As the inorganic phosphorus compound (Db), salts of phosphorus acid are preferred. In this description, the expression "easily soluble in water" means that 1 g of the compound dissolves in 10 ml of water at 25° C. Here, dissolution indicates a condition where the compound has dissolved in the solvent in a uniform state or has finely dispersed therein. Specifically, there is indicated a state not giving any precipitate in centrifugation at 12,000 rpm for 30 minutes.

The content of the organic phosphorus compound (Da) and the inorganic phosphorus compound (Db) is, as the content thereof in the treatment agent, 0.01 to 10 mass % each, more preferably 0.1 to 8 mass %, further more preferably 0.3 to 6 mass %.

It is preferred that the ratio by mass of the organic phosphorus compound (Da) to the inorganic phosphorus compound (Db), namely, Da/Db is 5/1 to 1/2, in terms of the phosphorus element therein. The ratio by mass in terms of phosphorus element as referred to herein means the ratio by mass of the phosphorus element contained in the organic phosphorus compound (Da) to the inorganic phosphorus compound (Db).

By containing the organic phosphorus compound (Da) within the concentration range mentioned above, the vanadium compound (B) can be stably dissolved in the treatment agent owing to the chelate effect. In addition, by containing the inorganic phosphorus compound (Db) within the concentration range mentioned above, a coating film having an excellent corrosion resistance can be formed along with the metal cation released by etching. Further, the presence of the organic phosphorus compound (Da) and the inorganic phosphorus compound (Db) in the ratio by mass mentioned above may attain both corrosion resistance and waterproofness.

The aqueous acrylic resin (E) for use in the metal surface treatment agent in the present invention is a polymer that has plural carboxyl groups through polymerization of a monomer having an ethylenic unsaturated double bond, and has a solid fraction acid value of 300 mg KOH/g or more. Preferably, the weight-average molecular weight of the resin is from 1,000 to 1,000,000. In this description, the weight-average molecular weight of resin may be measured in gel permeation chromatography (GPC) based on a polystyrene standard sample. The acid value and the hydroxy group value of the resin solid fraction in the present invention can be determined according to the method of JIS K 0070.

The aqueous acrylic resin includes a homopolymer prepared by radical polymerization of acrylic acid or methacrylic acid as a monomer, and a copolymer prepared by radical polymerization of the monomer and any other ethylenic unsaturated monomer. In the case of copolymer, examples of the other ethylenic unsaturated monomer include alkyl (meth)acrylates such as ethyl (meth)acrylate, butyl (meth)acrylate, etc.; hydroxyalkyl (meth)acrylates such as 2-hydroxyethyl (meth)acrylate, 2-hydroxypropyl (meth)acrylate, 4-hydroxybutyl (meth)acrylate, etc. The acid value of the aqueous acrylic resin (E) may be controlled by the monomer composition for use in polymerization.

The aqueous acrylic resin (E) may be obtained by polymerizing the above-mentioned monomer according to an ordinary method. For example, a monomer mixture is mixed with a known polymerization initiator (for example, azobisisobutyronitrile, etc.), dropwise put into a flask containing a solvent heated at a polymerizable temperature, and aged therein to give an aqueous acrylic resin.

Commercially-available aqueous acrylic resins include "Jurymer AC-10L" (polyacrylic acid, manufactured by Nippon Pure Chemical Co., Ltd.), "PIA728" (polyitaconic acid, manufactured by Iwata Chemical Co., Ltd.), and "Aquarick HL580" (polyacrylic acid, manufactured by Nippon Shokubai Co., Ltd.), etc.

Plural types of aqueous acrylic resins may be combined and used.

The aqueous acrylic resin (E) is contained in an amount of 100 ppm to 30,000 ppm as the concentration of the resin solid content in the treatment agent.

By containing in the concentration range mentioned above, the resin can further improve not only the adhesiveness to the metal material but also the adhesiveness to resin coating film and corrosion resistance. In particular, the effect of improving the adhesiveness to resin coating film is remarkable.

The metal surface treatment agent in the present invention further contains an oxazoline group-containing polymer (F) as a curing agent to form a crosslinked structure through reaction with the above-mentioned aqueous acrylic resin (E).

The oxazoline group-containing polymer (F) as a curing agent is an oxazoline group-containing polymer that contains at least two or more functional groups capable of reacting with the carboxyl group in the aqueous acrylic resin (E), in the molecule.

Specifically, the oxazoline group-containing polymer includes an oxazoline group-containing polymer produced through polymerization of a monomer composition containing an addition-polymerizable oxazoline such as 2-vinyl-2-oxazoline, 2-vinyl-4-methyl-2-oxazoline, 2-vinyl-5-methyl-2-oxazoline, 2-isopropenyl-2-oxazoline, 2-isopropenyl-4-methyl-2-oxazoline, 2-isopropenyl-5-ethyl-2-oxazoline, etc., and optionally any other polymerizing monomer. Commercial products of the polymer include "Epocros WS-700" (effective ingredient 25%, water-soluble type, oxazoline group-containing acrylic resin, manufactured by Nippon Shokubai Co., Ltd.), "Epocros WS-300" (effective ingredient 10%, water-soluble type, oxazoline group-containing acrylic resin, manufactured by Nippon Shokubai Co., Ltd.), etc.

The oxazoline group-containing polymer (F) as a curing agent is contained in an amount of 50 ppm to 5,000 ppm as the solid concentration in the treatment agent, and preferably, the ratio by mass of the solid content of the aqueous acrylic resin (E) to the oxazoline group-containing polymer (F) that is a curing agent for forming a crosslinked structure, namely, E/F is from 20/1 to 2/3.

By containing within the concentration range and in the ratio by mass mentioned above, the polymer may form a crosslinked structure with the aqueous acrylic resin (E), and further improves the adhesiveness to the metal material, the adhesiveness to resin coating film and the corrosion resistance.

The ratio by mass of the total mass, in terms of the metal elements therein, of the compound (A) having a zirconyl ($[Zr{=}O]^{2+}$) structure, the vanadium compound (B) and the titanium fluorocomplex compound (C) to the aqueous acrylic resin (E) and the oxazoline group-containing polymer (F), namely, (A+B+C)/(E+F) is 10/1 to 1/1. The expression "in terms of the metal elements therein" means that the calculation is based on the mass of the zirconium element that the zirconium compound (A) contains, the vanadium element that the vanadium compound (B) contains, and the titanium element that the titanium fluorocomplex compound (C) contains.

(A+B+C)/(E+F) of larger than 10/1 that indicates an inorganic substance-rich composition may provide a chemical conversion coating film having poor adhesiveness and corrosion resistance; and (A+B+C)/(E+F) of smaller than 1/1 that indicates an organic substance-rich composition may provide a chemical conversion coating film having poor corrosion resistance.

The pH of the metal surface treatment agent in the present invention must be 3 to 6. When the pH is more than 6, the adhesiveness between the metal material and the chemical conversion coating film is insufficient owing to etching insufficiency. On the other hand, when the pH is less than 3, the appearance of steel sheet is poor (powdery appearance occurs) owing to overetching. Here, powdery appearance means that surface of the steel sheet after chemical conversion treatment comes to look like a powdered surface, and when rubbed with a hand, a roll or the like, the coating film is readily peeled off.

The metal surface treatment agent in the present invention may be produced by mixing at least the zirconyl ($[Zr{=}O]^{2+}$) structure-having compound (A), the vanadium compound (B), the titanium fluorocomplex compound (C), the organic phosphorus compound (Da) and the inorganic phosphorus compound (Db), the aqueous acrylic resin (E) and the oxazoline group-containing polymer (F) as a curing agent, in water each in a predetermined amount. Here, the solid concentration of the chromium-free metal surface treatment agent in the present invention is preferably 0.1 to 20 mass %, more preferably 1 to 15 mass % relative to the treatment agent.

The metal surface treatment agent in the present invention is a chromium-free metal surface treatment agent substantially not containing any of a compound containing a hexavalent chromium and a compound containing a trivalent chromium, from the viewpoint of environmental and safety aspects. The expression "substantially not containing any chromium-containing compound" means that the content of metal chromium derived from the chromium compound in the metal surface treatment agent is less than 1 ppm.

Further, if desired, the metal surface treatment agent in the present invention may contain a thickener, a leveling agent, a wettability improver, a surfactant, a defoaming agent, a water-soluble alcohol, a cellosolve solvent, etc.

The surface treatment (chemical conversion treatment) with the chromium-free metal surface treatment agent in the present invention may be carried out as follows.

The pretreatment step before the chemical conversion treatment in the present invention is not specifically limited. In general, before the chemical conversion treatment, the metal material may be degreased with an alkali degreasing liquid for removing oil and dirt having adhered to the metal material, and subsequently, if desired, the surface conditioning process may be carried out through treatment with an acid, an alkali, a nickel compound, a cobalt compound or the like. In this, it is desirable that the surface of the metal material is washed with water after the treatment so that the degreasing liquid and others may remain as little as possible on the surface of the metal material.

The chemical conversion treatment in the present invention may be carried out by applying the surface treatment agent in the present invention onto the surface of a zinc-aluminum-magnesium alloy-plated steel sheet for chemical conversion coating film formation thereon according to a roll coating method, an air spraying method, an airless spraying method, a dipping method, a spin coating method, a flow coating method, a curtain coating method, a casting method or the like, followed by drying it to form a chemical conversion coating film in the drying step. During this, the treatment temperature is preferably within a range of 5 to 60° C., and the treatment time is preferably 1 to 300 seconds or so. When the treatment temperature and the treatment time each fall within the above range, a desired coating film can be formed well and the process is economically advantageous. The treatment temperature is more preferably 10 to 40° C., and the treatment time is more preferably 2 to 60 seconds.

The zinc-aluminum-magnesium alloy-plated steel sheet is applied to automobile bodies, automobile parts, building materials such as roof materials, external wall materials, supporting pillars for PVC greenhouses for agricultural use, etc., home electric appliances and their parts, guard rails, soundproof walls, sheet coils for use for civil engineering materials such as drainage channels, etc., and to other various shaped and worked articles, etc.

The drying step is not always necessary to add the heat, and any other physical removal by air drying, air blow drying or the like may be enough. However, for improving the film formability and the adhesiveness to a metal surface, the sheet may be dried by heating. In the case, the temperature is preferably 30 to 250° C., more preferably 40 to 200° C.

The amount of the chemical conversion coating film to be formed is, after drying, preferably 0.001 to 1 $g/m^2$, more preferably 0.02 to 0.5 $g/m^2$. When the amount is 0.001 to 1 $g/m^2$, sufficient corrosion resistance and adhesiveness to resin coating film can be maintained and the coating film can be prevented from cracking.

The chemical conversion coating film thus formed is excellent in corrosion resistance and additionally has good adhesiveness to the resin coating film to be mentioned below, which is formed on the coating film.

In the next step, a resin coating film layer comprising a paint, a lacquer, a laminate film or the like may be formed on the chemical conversion coating film formed in the above, according to a known method, by which the surface of the metal material (member) to be protected can be more effectively protected.

The thickness of the resin coating film layer to be formed is, after drying, preferably 0.3 to 50 μm.

EXAMPLES

The present invention is described in more detail with reference to the following Examples, but the present invention is not limited by these Examples.

Production Example 1

Preparation of Acrylic Resin (1)

775 parts of ion-exchanged water was put into a 4-neck vessel equipped with a heating and stirring unit, and with stirring under nitrogen reflux, the content fluid was heated at 80° C. Next, with still heating and stirring under nitrogen reflux, a mixed monomer liquid of 160 parts of acrylic acid, 20 parts of ethyl acrylate and 20 parts of 2-hydroxyethyl methacrylate, and a mixed liquid of 1.6 parts of ammonium persulfate and 23.4 parts of ion-exchanged water were dropwise added thereto through the respective dropping funnels over 3 hours. After the addition, heating and stirring under nitrogen reflux was still continued for 2 hours. Heating under nitrogen reflux was stopped, and the solution was cooled to 30° C. with stirring, and then filtered through a 200-mesh sieve to obtain an aqueous solution of a colorless and transparent, water-soluble acrylic resin (1). The aqueous solution of the acrylic resin (1) had a non-volatile content of 20%, a resin solid fraction acid value of 623 mg KOH/g, a resin solid fraction hydroxyl group value of 43 mg KOH/g, and a weight-average molecular weight of 8,400. The non-volatile content was derived from the residual mass obtained by heating 2 g of the aqueous solution of the acrylic resin (1) in an oven at 150° C. for 1 hour.

Production Example 2

Preparation of Acrylic Resin (2)

An acrylic resin was synthesized according to the same process as in Production Example 1 except that the monomer composition for the acrylic resin contained 30 parts of acrylic acid, 70 parts of ethyl acrylate and 100 parts of 2-hydroxyethyl methacrylate. During cooling the synthetic resin in the vessel, the liquid became cloudy at around 60° C., and therefore with stirring, 28.3 parts of 25% aqueous ammonia as a neutralizer was added. This was cooled down to 30° C. to give an aqueous solution of a pale reddish brown acrylic resin (2). The resultant aqueous solution of acrylic resin (2) had a nonvolatile content of 19.4%, a resin solid fraction acid value of 117, a resin solid fraction hydroxyl group value of 216, and a weight-average molecular weight of 11,600.

Production Examples 3 to 37

A zirconium compound (A), a vanadium compound (B), a metal fluorocomplex compound (C), an organic phosphorus compound (Da), an inorganic phosphorus compound (Db), an aqueous acrylic resin (E), and an oxazoline group-containing polymer (F) as a curing agent, were added to water each in the predetermined amount shown in Tables 1 to 3 below (in Comparative Examples, there may be the case that any components were not added). The metal surface treatment agents 1 to 35 are prepared so that the total amount become 1,000 parts by mass.

TABLE 1

| | Number of Metal Surface Treatment Agent | Zr Compound (A) type | Zr Compound (A) amount added [mass %] | V Compound (B) type | V Compound (B) amount added [mass %] | Metal Fluorocomplex Compound (C) type | Metal Fluorocomplex Compound (C) amount added [mass %] | Organic Phosphorus Compound (Da) type | Organic Phosphorus Compound (Da) amount added [mass %] |
|---|---|---|---|---|---|---|---|---|---|
| Production Example 3 | 1 | A1 | 1.30 | B1 | 1.10 | C1 | 2.10 | Da1<br>Da2 | 0.11<br>0.65 |
| Production Example 4 | 2 | A2 | 2.08 | B1 | 1.55 | C1 | 1.68 | Da1<br>Da3 | 0.51<br>2.86 |
| Production Example 5 | 3 | A3 | 0.77 | B1 | 0.35 | C1 | 0.56 | Da3 | 0.84 |
| Production Example 6 | 4 | A4 | 1.55 | B1 | 1.32 | C1 | 1.46 | Da1<br>Da2 | 0.35<br>0.88 |
| Production Example 7 | 5 | A1 | 0.81 | B1 | 0.88 | C1 | 0.75 | Da1<br>Da2 | 0.14<br>0.34 |
| Production Example 8 | 6 | A3 | 1.61 | B1 | 1.33 | C1 | 0.98 | Da1<br>Da3 | 0.21<br>0.43 |
| Production Example 9 | 7 | A2 | 0.80 | B1 | 0.66 | C1 | 0.43 | Da1<br>Da2 | 0.34<br>1.22 |
| Production Example 10 | 8 | A1 | 0.43 | B1 | 0.33 | C1 | 0.29 | Da3 | 2.30 |
| Production Example 11 | 9 | A2 | 1.02 | B1 | 0.90 | C1 | 1.03 | Da1<br>Da3 | 0.15<br>1.00 |
| Production Example 12 | 10 | A4 | 0.16 | B1 | 0.14 | C1 | 0.18 | Da2 | 0.25 |
| Production Example 13 | 11 | A1 | 1.00 | B1 | 0.66 | C1 | 0.98 | Da1<br>Da3 | 0.13<br>0.75 |
| Production Example 14 | 12 | A2 | 0.98 | B1 | 0.82 | C1 | 0.96 | Da1<br>Da3 | 0.12<br>0.91 |

| | Inorganic Phosphorus Compound (Db) type | Inorganic Phosphorus Compound (Db) amount added [mass %] | Aqueous Acrylic Resin (E) type | Aqueous Acrylic Resin (E) amount added [mass %] | Curing Agent (F) type | Curing Agent (F) amount added [mass %] | pH |
|---|---|---|---|---|---|---|---|
| Production Example 3 | Db1 | 2.03 | E1 | 1.44 | F1 | 0.04 | 4.2 |
| Production Example 4 | Db1 | 0.21 | E1 | 1.51 | F1 | 0.06 | 4.8 |
| Production Example 5 | Db2 | 1.10 | E2 | 0.11 | F2 | 0.48 | 4.7 |
| Production Example 6 | Db1 | 0.22 | E1<br>E3 | 0.58<br>0.51 | F1 | 0.04 | 4.1 |
| Production Example 7 | Db1 | 1.21 | E1 | 0.21 | F2 | 0.08 | 5.8 |
| Production Example 8 | Db2 | 1.33 | E2<br>E3 | 0.11<br>0.18 | F1 | 0.08 | 5.6 |
| Production Example 9 | Db1 | 0.21 | E2<br>E3 | 0.10<br>0.15 | F2 | 0.08 | 5.4 |
| Production Example 10 | Db2 | 0.16 | E3 | 0.11 | F2 | 0.08 | 3.8 |
| Production Example 11 | Db2 | 0.09 | E1<br>E3 | 0.08<br>0.08 | F1 | 0.03 | 4.9 |
| Production Example 12 | Db1 | 0.87 | E2<br>E3 | 0.09<br>0.08 | F1 | 0.01 | 5.4 |
| Production Example 13 | Db1 | 0.24 | E1 | 1.06 | F1 | 0.04 | 5.6 |
| Production Example 14 | Db1 | 0.24 | E1<br>E3 | 0.51<br>0.48 | F1 | 0.03 | 3.7 |

TABLE 2

| | Number of Metal Surface Treatment Agent | Zr Compound (A) type | Zr Compound (A) amount added [mass %] | V Compound (B) type | V Compound (B) amount added [mass %] | Metal Fluorocomplex Compound (C) type | Metal Fluorocomplex Compound (C) amount added [mass %] | Organic Phosphorus Compound (Da) type | Organic Phosphorus Compound (Da) amount added [mass %] |
|---|---|---|---|---|---|---|---|---|---|
| Production Example 15 | 13 | A2 | 0.51 | B1 | 0.73 | C1 | 0.82 | Da1<br>Da3 | 0.22<br>0.57 |

TABLE 2-continued

| | | | | | | | | | |
|---|---|---|---|---|---|---|---|---|---|
| Production Example 16 | 14 | A3 | 1.02 | B1 | 0.71 | C1 | 0.69 | Da1<br>Da2 | 0.20<br>0.88 |
| Production Example 17 | 15 | A1 | 0.28 | B1 | 0.51 | C1 | 0.11 | Da1<br>Da2 | 0.61<br>0.39 |
| Production Example 18 | 16 | A4 | 0.88 | B1 | 1.50 | C1 | 0.81 | Da1<br>Da2 | 0.55<br>0.41 |
| Production Example 19 | 17 | A1 | 1.03 | B1 | 1.21 | C1 | 0.99 | Da1<br>Da3 | 0.24<br>1.01 |
| Production Example 20 | 18 | A1 | 0.20 | B1 | 0.38 | C1 | 0.29 | Da2<br>Da3 | 0.04<br>0.26 |
| Production Example 21 | 19 | A2 | 1.38 | B1 | 1.85 | C1 | 1.22 | Da1<br>Da2 | 0.89<br>0.77 |
| Production Example 22 | 20 | A1 | 0.81 | B1 | 1.50 | C1 | 1.19 | Da1<br>Da3 | 0.15<br>1.12 |
| Production Example 23 | 21 | A2 | 1.10 | B1 | 3.12 | C1 | 1.43 | Da1<br>Da3 | 0.43<br>1.10 |
| Production Example 24 | 22 | A3 | 0.51 | B2 | 1.46 | C1 | 0.70 | Da1<br>Da3 | 0.19<br>0.58 |
| Production Example 25 | 23 | A2 | 0.42 | B1 | 0.26 | C1 | 0.55 | Da1<br>Da2 | 0.19<br>0.88 |
| Production Example 26 | 24 | A4 | 0.66 | B1 | 1.53 | C1 | 0.91 | Da1<br>Da3 | 0.22<br>0.67 |

| | Inorganic Phosphorus Compound (Db) | | Aqueous Acrylic Resin (E) | | Curing Agent (F) | | |
|---|---|---|---|---|---|---|---|
| | type | amount added [mass %] | type | amount added [mass %] | type | amount added [mass %] | pH |
| Production Example 15 | Db1 | 0.59 | E2 | 0.06 | F1 | 0.14 | 3.4 |
| Production Example 16 | Db2 | 0.32 | E1<br>E3 | 0.10<br>0.02 | F2 | 0.30 | 4.1 |
| Production Example 17 | Db1 | 0.24 | E2 | 0.03 | F1 | 0.11 | 4.9 |
| Production Example 18 | Db1 | 0.24 | E1<br>E3 | 0.18<br>0.26 | F2 | 0.01 | 4.6 |
| Production Example 19 | Db1 | 0.46 | E1 | 0.56 | F1 | 0.08 | 3.1 |
| Production Example 20 | Db2 | 0.11 | E3 | 0.12 | F2 | 0.02 | 5.1 |
| Production Example 21 | Db1 | 0.59 | E2 | 0.17 | F1 | 0.06 | 3.8 |
| Production Example 22 | Db1 | 0.44 | E1<br>E3 | 0.19<br>0.33 | F1 | 0.07 | 4.1 |
| Production Example 23 | Db1 | 0.23 | E1<br>E2 | 0.47<br>0.26 | F2 | 0.08 | 3.3 |
| Production Example 24 | Db1 | 0.10 | E2<br>E3 | 0.12<br>0.10 | F1 | 0.08 | 5.7 |
| Production Example 25 | Db2 | 0.33 | E2<br>E3 | 0.11<br>0.10 | F1 | 0.27 | 3.4 |
| Production Example 26 | Db1 | 0.83 | E1 | 0.25 | F2 | 0.08 | 3.3 |

TABLE 3

| | Number of Metal Surface Treatment Agent | Zr Compound (A) | | V Compound (B) | | Metal Fluorocomplex Compound (C) | | Organic Phosphorus Compound (Da) | |
|---|---|---|---|---|---|---|---|---|---|
| | | type | amount added [mass %] | type | amount added [mass %] | type | amount added [mass %] | type | amount added [mass %] |
| Production Example 27 | 25 | A1 | 0.65 | B1 | 0.81 | C2 | 1.50 | Da1<br>Da3 | 0.33<br>1.00 |
| Production Example 28 | 26 | A2 | 1.01 | B1 | 1.34 | C1 | 0.88 | Da1<br>Da3 | 0.33<br>1.00 |
| Production Example 29 | 27 | A1 | 0.58 | B1 | 0.66 | C1 | 1.02 | Da1<br>Da2 | 1.58<br>0.33 |
| Production Example 30 | 28 | A4 | 0.43 | B1 | 0.51 | C1 | 0.65 | Da1<br>Da2 | 0.36<br>1.22 |
| Production Example 31 | 29 | A1 | 1.22 | B1 | 0.85 | C1 | 1.23 | Da2<br>Da3 | 0.38<br>1.60 |
| Production Example 32 | 30 | A3 | 1.10 | — | — | C1 | 1.70 | Da1<br>Da3 | 0.21<br>1.30 |

TABLE 3-continued

| | | | | | | | | | |
|---|---|---|---|---|---|---|---|---|---|
| Production Example 33 | 31 | A1 | 0.99 | B1 | 1.32 | — | — | Da2<br>Da3 | 0.15<br>0.89 |
| Production Example 34 | 32 | A2 | 1.48 | B1 | 0.96 | C1 | 1.96 | — | — |
| Production Example 35 | 33 | A2 | 0.65 | B1 | 0.81 | C1 | 1.02 | Da1<br>Da3 | 0.33<br>1.00 |
| Production Example 36 | 34 | A3 | 1.01 | B2 | 1.34 | C1 | 0.88 | Da2<br>Da3 | 0.33<br>1.02 |
| Production Example 37 | 35 | A2 | 0.43 | B1 | 0.51 | C1 | 0.65 | Da1<br>Da2 | 0.36<br>1.22 |

| | Inorganic Phosphorus Compound (Db) | | Aqueous Acrylic Resin (E) | | Curing Agent (F) | | |
|---|---|---|---|---|---|---|---|
| | type | amount added [mass %] | type | amount added [mass %] | type | amount added [mass %] | pH |
| Production Example 27 | Db2 | 0.41 | E1 | 0.32 | F1 | 0.08 | 4.6 |
| Production Example 28 | Db1 | 0.58 | E4 | 0.19 | F1 | 0.08 | 3.8 |
| Production Example 29 | Db1 | 0.86 | E5 | 0.33 | F1 | 0.10 | 4.3 |
| Production Example 30 | Db1 | 0.41 | E2<br>E3 | 0.16<br>0.16 | F1 | 0.08 | 6.6 |
| Production Example 31 | Db2 | 0.33 | E1 | 0.09 | F2 | 0.02 | 4.7 |
| Production Example 32 | Db1 | 0.42 | E1 | 0.32 | F1 | 0.08 | 5.8 |
| Production Example 33 | Db1 | 0.16 | E1 | 1.03 | F2 | 0.08 | 3.3 |
| Production Example 34 | Db1 | 0.42 | E1 | 0.15 | F2 | 0.08 | 4.1 |
| Production Example 35 | — | — | E1 | 0.32 | F1 | 0.08 | 4.3 |
| Production Example 36 | Db1 | 0.58 | — | — | F1 | 0.08 | 5.7 |
| Production Example 37 | Db2 | 0.66 | E1 | 0.16 | F3 | 0.08 | 4.5 |

Explanatory notes in the above Tables 1 to 3 are as follows.

(Zirconium Compound (A))

A1: zirconyl nitrate (cation, $ZrO^{2+}$)

A2: zirconyl acetate (cation, $ZrO^{2+}$)

A3: zirconyl sulfate (cation, $ZrO^{2+}$)

A4: zirconyl ammonium carbonate (cation, $ZrO^{2+}$)

(Vanadium Compound (B))

B1: ammonium metavanadate

B2: sodium metavanadate (Metal Fluorocomplex Compound (C))

C1: ammonium titanium fluoride (anion, $TiF_6^{2-}$)

C2: ammonium zirconium fluoride (anion, $ZrF_6^{2-}$)

(Organic Phosphorus Compound (Da))

Da1: 1-hydroxyethylidene-1,1-diphosphonic acid

Da2: aminotrimethylenephosphonic acid

Da3: 2-phosphonobutane-1,2,4-tricarboxylic acid (Inorganic Phosphorus Compound (Db))

Db1: monoammonium dihydrogen phosphate

Db2: diammonium monohydrogen phosphate (Aqueous Acrylic Resin (E))

E1: low-molecular-weight polyacrylic acid ("Jurymer AC-10L" manufactured by Nippon Pure Chemical Co., Ltd., solid fraction acid value: 779 mg KOH/g, weight-average molecular weight: 20,000 to 30,000, nonvolatile matter: 40%)

E2: high-molecular-weight polyacrylic acid ("Jurymer AC-10H" manufactured by Nippon Pure Chemical Co., Ltd., solid fraction acid value: 779 mg KOH/g, weight-average molecular weight: 150,000, nonvolatile matter: 20%)

E3: acrylic resin (1) (prepared in Production Example 1; solid fraction acid value: 623 mg KOH/g, weight-average molecular weight: 8,400)

E4: Adeka Bontighter HUX-232 (aqueous urethane resin manufactured by Adeka Corporation, solid fraction acid value: 30 mg KOH/g, nonvolatile matter: 30%)

E5: acrylic resin (2) (prepared in Production Example 2; solid fraction acid value: 117 mg KOH/g, weight-average molecular weight: 11,600)

(Oxazoline Group-Containing Polymer (F) as Curing Agent)

F1: oxazoline group-containing acrylic resin ("Epocros WS-300" manufactured by Nippon Shokubai Co., Ltd.)

F2: oxazoline group-containing acrylic resin ("Epocros WS-500" manufactured by Nippon Shokubai Co., Ltd.)

F3: polycarbodiimide ("Carbodilite SW-12G" manufactured by Nisshinbo Chemical Inc.)

(Test Sheet)

Using a cold-rolled steel sheet having a thickness of 0.5 mm as a raw sheet, a Zn—Al—Mg alloy plated steel strip having a molten plating layer having a composition shown in Table 4 below was produced. Each steel strip was cut into plated steel sheets of 210 mm×300 mm. The plating amount was 60 g/m$^2$ per one side.

TABLE 4

(mass %)

| Plated Steel Sheet | Al | Mg | Si, Ti, B | Zn |
|---|---|---|---|---|
| P1 | 4.2 | 1.5 | — | balance |
| P2 | 6.0 | 3.0 | Si: 0.02 | balance |

TABLE 4-continued

| Plated Steel Sheet | Al | Mg | Si, Ti, B | Zn (mass %) |
|---|---|---|---|---|
| P3 | 6.0 | 3.0 | Si: 0.02, Ti: 0.05, B: 0.003 | balance |
| P4 | 6.0 | 3.0 | — | balance |
| P5 | 8.1 | 3.0 | — | balance |
| P6 | 9.8 | 3.0 | — | balance |
| P7 | 9.8 | 3.0 | Si: 0.21 | balance |
| P21 | 1.1 | 9.4 | — | balance |
| P22 | 1.1 | 6.0 | — | balance |
| P23 | 1.2 | 1.1 | — | balance |
| P24 | 1.5 | 1.5 | — | balance |
| P25 | 2.5 | 3.0 | — | balance |
| P26 | 2.5 | 3.0 | Si: 0.040 | balance |
| P27 | 3.5 | 3.0 | — | balance |
| P28 | 3.9 | 9.6 | — | balance |
| P29 | 3.9 | 1.1 | — | balance |
| P30 | 2.5 | 3.0 | Ti: 0.05, B: 0.003 | balance |
| P31 | 2.5 | 3.0 | Si: 0.02, Ti: 0.05, B: 0.003 | balance |
| P32 | 0.8 | 0.7 | — | balance |

Examples 1 to 68 and Comparative Examples 1 to 23

(Degreasing/Surface Treatment)

The above-mentioned plated steel sheet was degreased by spraying with an alkali degreasing agent (SURFCLEANER 155 manufactured by Nippon Paint Co., Ltd.) at 60° C. for 2 minutes, then rinsed with water, and dried at 80° C. Subsequently, the metal surface treatment agent produced in the above-mentioned Production Example was, after the solid concentration was controlled to realize a dry coating amount (0.2 g/$m^2$) as in Tables 5 to 10 given below, applied onto the above-mentioned, degreased plated steel plate with a bar coater, and dried so that the achieving temperature of the metal substrate could be 80° C., using a hot air circulating oven, thereby producing a test sheet having a chemical conversion coating film formed thereon.

[Formation of Resin Coating Film Layer]

An epoxy adhesive was applied to the surface of the test sheet, and a vinyl chloride film was attached thereto to prepare a laminate steel sheet.

From each chemical conversion-treated steel sheet and each laminate steel sheet produced in the above, test pieces were cut out to prepare test sheets, and the evaluation tests mentioned below were performed. The results are shown in Tables 5 to 10 below.

(Film Working Adhesiveness)

A JIS No. 13 A test piece was cut out of the film-adhered laminate steel sheet, and the test piece was elongated by 18% using a tensile tester. Subsequently, two parallel cutting lines were given to the horizontal part of the film of the test piece, at an interval of 15 mm in the length direction of the test piece, and the film between the parallel lines were forcedly peeled, and the peeling strength was measured. The test piece was evaluated according to the following criteria. Those given a score of 3 or more are on a passing grade.

<Evaluation Criteria>

4: Peeling strength of 50 N/15 mm or more.

3: Peeling strength of 37.5 N/15 mm or more and less than 50 N/15 mm.

2: Peeling strength of 15 N/15 mm or more and less than 37.5 N/15 mm.

1: Peeling strength of less than 15 N/15 mm.

(Waterproofness)

A JIS No. 13 A test piece was cut out of the film-adhered laminate steel sheet, immersed in boiling water for 4 hours, and then the film peeling strength (N/15 mm) in the flat area of the test piece was measured according to the same method as that for the above-mentioned film working adhesiveness test. The evaluation was carried out according to the following criteria. Those given a score of 3 or more are on a passing grade.

<Evaluation Criteria>

4: Peeling strength of 50 N/15 mm or more.

3: Peeling strength of 37.5 N/15 mm or more and less than 50 N/15 mm.

2: Peeling strength of 15 N/15 mm or more and less than 37.5 N/15 mm.

1: Peeling strength of less than 15 N/15 mm.

(Appearance (Powdery Appearance))

The appearance of each test sheet after the chemical conversion treatment (as to whether or not the test sheet came to have a powdery appearance) was visually checked. The evaluation was carried out according to the following criteria. Those given a score of 3 are on a passing grade.

<Evaluation Criteria>

3: When the surface was rubbed with a hand or a roll, no powder (=coating film) dropped.

1: When the surface was rubbed with a hand or a roll, some powder (=coating film) dropped.

(Bath Stability)

The produced metal surface treatment agent was stored in each thermostatic bath of 40° C. and 5° C. for a certain period of time (one month), and checked for the presence or absence of thickening or sedimentation. The evaluation was carried out according to the following criteria. Those given a score of 3 are on a passing grade.

<Evaluation Criteria>

3: After storage in each thermostatic bath of 40° C. and 5° C. for 1 month, neither thickening nor sedimentation occurred.

1: After storage in each thermostatic bath of 40° C. and 5° C. for 1 month, thickening or sedimentation occurred.

(Corrosion Resistance (Temporary Rustproofness))

Four corners of the chemical conversion-treated steel sheet (before adhesion for lamination) were tape-sealed and tested according to an SST test (salt spraying test). The evaluation was carried out according to the following criteria. Those with no white rust in 24 hours or more are on a passing grade. Subsequently, the test was continued up to 72 hours, and those having a higher value for a long period of time are better.

<Evaluation Criteria>

Time: Period of time in which no white rust formed in the flat area.

-: White rust occurred in the flat area in 24 hours in the SST test.

TABLE 5

| | Formulation of Treatment Agent | Plated Steel Sheet | Amount of Coating Film [g/m$^2$] | Surface Conditioning Agent | Film Adhesiveness | | Appearance (powdery appearance) | Bath Stability | | Corrosion Resistance |
|---|---|---|---|---|---|---|---|---|---|---|
| | | | | | Workability | Waterproofness | | 40° C. | 5° C. | |
| Example 1 | Production Example 3 | P1 | 0.2 | Ni | 4 | 4 | 3 | 3 | 3 | 24 h |
| Example 2 | Production Example 3 | P2 | 0.2 | Ni | 4 | 4 | 3 | 3 | 3 | 24 h |
| Example 3 | Production Example 3 | P3 | 0.2 | Ni | 4 | 4 | 3 | 3 | 3 | 24 h |
| Example 4 | Production Example 3 | P4 | 0.2 | Ni | 4 | 4 | 3 | 3 | 3 | 24 h |
| Example 5 | Production Example 3 | P5 | 0.2 | Ni | 4 | 4 | 3 | 3 | 3 | 24 h |
| Example 6 | Production Example 3 | P6 | 0.2 | Ni | 4 | 4 | 3 | 3 | 3 | 24 h |
| Example 7 | Production Example 3 | P7 | 0.2 | Ni | 4 | 4 | 3 | 3 | 3 | 24 h |
| Example 8 | Production Example 4 | P3 | 0.2 | — | 3 | 3 | 3 | 3 | 3 | 24 h |
| Example 9 | Production Example 5 | P3 | 0.2 | — | 3 | 3 | 3 | 3 | 3 | 24 h |
| Example 10 | Production Example 6 | P3 | 0.2 | Ni | 4 | 4 | 3 | 3 | 3 | 24 h |
| Example 11 | Production Example 7 | P3 | 0.2 | Ni | 4 | 4 | 3 | 3 | 3 | 48 h |
| Example 12 | Production Example 8 | P3 | 0.2 | — | 4 | 3 | 3 | 3 | 3 | 48 h |
| Example 13 | Production Example 9 | P3 | 0.2 | Ni | 4 | 4 | 3 | 3 | 3 | 48 h |
| Example 14 | Production Example 10 | P3 | 0.2 | — | 4 | 3 | 3 | 3 | 3 | 48 h |
| Example 15 | Production Example 11 | P3 | 0.2 | Ni | 4 | 4 | 3 | 3 | 3 | 48 h |
| Example 16 | Production Example 12 | P3 | 0.2 | Ni | 4 | 4 | 3 | 3 | 3 | 48 h |
| Example 17 | Production Example 13 | P3 | 0.2 | — | 3 | 4 | 3 | 3 | 3 | 48 h |
| Example 18 | Production Example 14 | P3 | 0.2 | Ni | 4 | 4 | 3 | 3 | 3 | 48 h |

TABLE 6

| | Formulation of Treatment Agent | Plated Steel Sheet | Amount of Coating Film [g/m$^2$] | Surface Conditioning Agent | Film Adhesiveness | | Appearance (powdery appearance) | Bath Stability | | Corrosion Resistance |
|---|---|---|---|---|---|---|---|---|---|---|
| | | | | | Workability | Waterproofness | | 40° C. | 5° C. | |
| Example 19 | Production Example 15 | P3 | 0.2 | Ni | 4 | 4 | 3 | 3 | 3 | 48 h |
| Example 20 | Production Example 16 | P3 | 0.2 | Ni | 4 | 4 | 3 | 3 | 3 | 48 h |
| Example 21 | Production Example 17 | P3 | 0.2 | — | 3 | 4 | 3 | 3 | 3 | 48 h |
| Example 22 | Production Example 18 | P3 | 0.2 | Ni | 4 | 4 | 3 | 3 | 3 | 48 h |
| Example 23 | Production Example 19 | P3 | 0.2 | Ni | 4 | 4 | 3 | 3 | 3 | 72 h |
| Example 24 | Production Example 20 | P3 | 0.2 | Ni | 4 | 4 | 3 | 3 | 3 | 72 h |
| Example 25 | Production Example 21 | P3 | 0.2 | — | 4 | 4 | 3 | 3 | 3 | 72 h |
| Example 26 | Production Example 22 | P3 | 0.2 | Ni | 4 | 4 | 3 | 3 | 3 | 72 h |
| Example 27 | Production Example 23 | P3 | 0.2 | Ni | 4 | 4 | 3 | 3 | 3 | 72 h |
| Example 28 | Production Example 24 | P3 | 0.2 | Ni | 4 | 3 | 3 | 3 | 3 | 72 h |
| Example 29 | Production Example 25 | P3 | 0.2 | — | 4 | 4 | 3 | 3 | 3 | 72 h |
| Example 30 | Production Example 26 | P3 | 0.2 | Ni | 4 | 4 | 3 | 3 | 3 | 72 h |

TABLE 7

| | Formulation of Treatment Agent | Plated Steel Sheet | Amount of Coating Film [g/m$^2$] | Surface Conditioning Agent | Film Adhesiveness | | Appearance (powdery appearance) | Bath Stability | | Corrosion Resistance |
|---|---|---|---|---|---|---|---|---|---|---|
| | | | | | Workability | Waterproofness | | 40° C. | 5° C. | |
| Comparative Example 1 | Production Example 27 | P3 | 0.2 | — | 3 | 2 | 3 | 3 | 3 | — |
| Comparative Example 2 | Production Example 28 | P3 | 0.2 | — | 2 | 1 | 3 | 3 | 3 | 24 h |
| Comparative Example 3 | Production Example 29 | P3 | 0.2 | — | 2 | 1 | 3 | 3 | 3 | 24 h |
| Comparative Example 4 | Production Example 30 | P3 | 0.2 | — | 2 | 2 | 3 | 3 | 3 | — |
| Comparative Example 5 | Production Example 31 | P3 | 0.2 | — | 3 | 2 | 3 | 3 | 3 | — |
| Comparative Example 6 | Production Example 32 | P3 | 0.2 | — | 4 | 4 | 1 | 3 | 3 | — |
| Comparative Example 7 | Production Example 33 | P3 | 0.2 | — | 2 | 1 | 1 | 1 | 3 | — |
| Comparative Example 8 | Production Example 34 | P3 | 0.2 | — | 2 | 2 | 3 | 1 | 1 | — |
| Comparative Example 9 | Production Example 35 | P3 | 0.2 | — | 3 | 3 | 3 | 3 | 3 | — |
| Comparative Example 10 | Production Example 36 | P3 | 0.2 | — | 2 | 1 | 1 | 3 | 3 | 24 h |
| Comparative Example 11 | Production Example 37 | P3 | 0.2 | — | 3 | 2 | 3 | 3 | 3 | — |

TABLE 8

| | Formulation of Treatment Agent | Plated Steel Sheet | Amount of Coating Film [g/m$^2$] | Surface Conditioning Agent | Film Adhesiveness | | Appearance (powdery appearance) | Bath Stability | | Corrosion Resistance |
|---|---|---|---|---|---|---|---|---|---|---|
| | | | | | Workability | Waterproofness | | 40° C. | 5° C. | |
| Example 31 | Production Example 14 | P21 | 0.2 | — | 3 | 3 | 3 | 3 | 3 | 48 h |
| Example 32 | Production Example 14 | P22 | 0.2 | — | 3 | 3 | 3 | 3 | 3 | 48 h |
| Example 33 | Production Example 14 | P23 | 0.2 | — | 3 | 3 | 3 | 3 | 3 | 24 h |
| Example 34 | Production Example 14 | P24 | 0.2 | — | 3 | 3 | 3 | 3 | 3 | 24 h |
| Example 35 | Production Example 14 | P25 | 0.2 | — | 3 | 3 | 3 | 3 | 3 | 24 h |
| Example 36 | Production Example 14 | P26 | 0.2 | — | 3 | 3 | 3 | 3 | 3 | 24 h |
| Example 37 | Production Example 14 | P27 | 0.2 | — | 3 | 3 | 3 | 3 | 3 | 24 h |
| Example 38 | Production Example 14 | P28 | 0.2 | — | 3 | 3 | 3 | 3 | 3 | 48 h |
| Example 39 | Production Example 14 | P29 | 0.2 | — | 3 | 3 | 3 | 3 | 3 | 24 h |
| Example 40 | Production Example 14 | P30 | 0.2 | — | 3 | 3 | 3 | 3 | 3 | 24 h |
| Example 41 | Production Example 14 | P31 | 0.2 | — | 3 | 3 | 3 | 3 | 3 | 24 h |
| Example 42 | Production Example 14 | P23 | 0.2 | Ni | 4 | 4 | 3 | 3 | 3 | 24 h |
| Example 43 | Production Example 14 | P24 | 0.2 | Ni | 4 | 4 | 3 | 3 | 3 | 24 h |
| Example 44 | Production Example 14 | P26 | 0.2 | Ni | 4 | 4 | 3 | 3 | 3 | 24 h |
| Example 45 | Production Example 14 | P27 | 0.2 | Ni | 4 | 4 | 3 | 3 | 3 | 24 h |
| Example 46 | Production Example 3 | P25 | 0.2 | — | 3 | 3 | 3 | 3 | 3 | 24 h |
| Example 47 | Production Example 4 | P25 | 0.2 | — | 3 | 3 | 3 | 3 | 3 | 24 h |
| Example 48 | Production Example 5 | P25 | 0.2 | — | 3 | 3 | 3 | 3 | 3 | 24 h |
| Example 49 | Production Example 6 | P25 | 0.2 | — | 3 | 3 | 3 | 3 | 3 | 24 h |
| Example 50 | Production Example 7 | P25 | 0.2 | — | 3 | 3 | 3 | 3 | 3 | 24 h |
| Example 51 | Production Example 8 | P25 | 0.2 | — | 3 | 3 | 3 | 3 | 3 | 24 h |

TABLE 8-continued

| | Formulation of Treatment Agent | Plated Steel Sheet | Amount of Coating Film [g/m$^2$] | Surface Conditioning Agent | Film Adhesiveness | | Appearance (powdery appearance) | Bath Stability | | Corrosion Resistance |
|---|---|---|---|---|---|---|---|---|---|---|
| | | | | | Workability | Waterproofness | | 40° C. | 5° C. | |
| Example 52 | Production Example 9 | P25 | 0.2 | — | 3 | 3 | 3 | 3 | 3 | 24 h |
| Example 53 | Production Example 10 | P25 | 0.2 | — | 3 | 3 | 3 | 3 | 3 | 24 h |
| Example 54 | Production Example 11 | P25 | 0.2 | — | 3 | 3 | 3 | 3 | 3 | 24 h |
| Example 55 | Production Example 12 | P25 | 0.2 | — | 3 | 3 | 3 | 3 | 3 | 24 h |
| Example 56 | Production Example 13 | P25 | 0.2 | — | 3 | 3 | 3 | 3 | 3 | 24 h |

TABLE 9

| | Formulation of Treatment Agent | Plated Steel Sheet | Amount of Coating Film [g/m$^2$] | Surface Conditioning Agent | Film Adhesiveness | | Appearance (powdery appearance) | Bath Stability | | Corrosion Resistance |
|---|---|---|---|---|---|---|---|---|---|---|
| | | | | | Workability | Waterproofness | | 40° C. | 5° C. | |
| Example 57 | Production Example 15 | P27 | 0.2 | Ni | 4 | 4 | 3 | 3 | 3 | 24 h |
| Example 58 | Production Example 16 | P27 | 0.2 | Ni | 4 | 4 | 3 | 3 | 3 | 24 h |
| Example 59 | Production Example 17 | P27 | 0.2 | — | 4 | 4 | 3 | 3 | 3 | 24 h |
| Example 60 | Production Example 18 | P27 | 0.2 | Ni | 4 | 4 | 3 | 3 | 3 | 24 h |
| Example 61 | Production Example 19 | P27 | 0.2 | Ni | 4 | 4 | 3 | 3 | 3 | 48 h |
| Example 62 | Production Example 20 | P27 | 0.2 | Ni | 4 | 4 | 3 | 3 | 3 | 48 h |
| Example 63 | Production Example 21 | P27 | 0.2 | — | 4 | 4 | 3 | 3 | 3 | 48 h |
| Example 64 | Production Example 22 | P27 | 0.2 | Ni | 4 | 4 | 3 | 3 | 3 | 48 h |
| Example 65 | Production Example 23 | P27 | 0.2 | Ni | 4 | 4 | 3 | 3 | 3 | 48 h |
| Example 66 | Production Example 24 | P27 | 0.2 | Ni | 4 | 4 | 3 | 3 | 3 | 48 h |
| Example 67 | Production Example 25 | P27 | 0.2 | — | 4 | 4 | 3 | 3 | 3 | 48 h |
| Example 68 | Production Example 26 | P27 | 0.2 | Ni | 4 | 4 | 3 | 3 | 3 | 48 h |

TABLE 10

| | Formulation of Treatment Agent | Plated Steel Sheet | Amount of Coating Film [g/m$^2$] | Surface Conditioning Agent | Film Adhesiveness | | Appearance (powdery appearance) | Bath Stability | | Corrosion Resistance |
|---|---|---|---|---|---|---|---|---|---|---|
| | | | | | Workability | Waterproofness | | 40° C. | 5° C. | |
| Comparative Example 12 | Production Example 27 | P31 | 0.2 | — | 3 | 2 | 2 | 3 | 3 | — |
| Comparative Example 13 | Production Example 28 | P31 | 0.2 | — | 2 | 1 | 3 | 3 | 3 | 24 h |
| Comparative Example 14 | Production Example 29 | P31 | 0.2 | — | 2 | 1 | 3 | 3 | 3 | 24 h |
| Comparative Example 15 | Production Example 30 | P31 | 0.2 | — | 3 | 2 | 3 | 3 | 3 | — |
| Comparative Example 16 | Production Example 31 | P31 | 0.2 | — | 3 | 2 | 3 | 3 | 3 | — |
| Comparative Example 17 | Production Example 32 | P31 | 0.2 | — | 4 | 4 | 1 | 3 | 3 | — |
| Comparative Example 18 | Production Example 33 | P31 | 0.2 | — | 2 | 1 | 1 | 1 | 3 | — |
| Comparative Example 19 | Production Example 34 | P31 | 0.2 | — | 2 | 2 | 3 | 1 | 1 | — |
| Comparative Example 20 | Production Example 35 | P31 | 0.2 | — | 3 | 3 | 3 | 3 | 3 | — |
| Comparative Example 21 | Production Example 36 | P31 | 0.2 | — | 2 | 1 | 1 | 3 | 3 | 24 h |

TABLE 10-continued

| | Formulation of Treatment Agent | Plated Steel Sheet | Amount of Coating Film [g/m$^2$] | Surface Conditioning Agent | Film Adhesiveness Workability | Film Adhesiveness Waterproofness | Appearance (powdery appearance) | Bath Stability 40° C. | Bath Stability 5° C. | Corrosion Resistance |
|---|---|---|---|---|---|---|---|---|---|---|
| Comparative Example 22 | Production Example 37 | P31 | 0.2 | — | 3 | 2 | 3 | 3 | 3 | — |
| Comparative Example 23 | Production Example 14 | P32 | 0.2 | — | 3 | 3 | 1 | 3 | 3 | 24 h |

Explanatory notes in the above Tables 5 to 10 are as follows.

(Surface Conditioning Agent)

Ni: nickel-based surface conditioning agent (NP Conditioner 710 manufactured by Nippon Paint Co., Ltd.)

-: no surface conditioning

Ni coating amount was 5 mg/m$^2$.

From Tables 5 to 10, it is known that all the metal surface treatment agents of Examples formed coating films that are more excellent in corrosion resistance and waterproofness and have better adhesiveness to zinc-aluminum-magnesium alloy-plated steel sheets and to the laminate film of the resin coating film formed on the steel sheets, than those formed of the metal surface treatment agents of Comparative Examples.

In Comparative Examples 1 and 12, ammonium zirconium fluoride was used in place of ammonium titanium fluoride, but the waterproofness and the corrosion resistance was poor.

In Comparative Examples 2 and 13 and Comparative Examples 3 and 14, an aqueous urethane resin having a low acid value or an aqueous acrylic resin having a low acid value was used in place of the aqueous acrylic resin having a high acid value, but the adhesiveness was poor.

In Comparative Examples 4 and 15, the pH was higher than 6 and the etching was insufficient, and therefore the adhesiveness was poor.

In Comparative Examples 5 and 16, (A+B+C)/(E+F) is larger than 10/1 (the amount of the inorganic substance was large), and therefore the adhesiveness or the corrosion resistance was poor.

Comparative Examples 6 and 17 did not contain a vanadium compound, in which, therefore the corrosion resistance was poor and the appearance looked powdery.

Comparative Examples 7 and 18 did not contain a titanium fluoride compound, in which, therefore the corrosion resistance and the adhesiveness were poor.

Comparative Examples 8 and 19 did not contain an organic phosphorus compound, in which, therefore, the vanadium compound dissolved poorly and the corrosion resistance was poor.

Comparative Examples 9 and 20 did not contain an inorganic phosphorus compound, in which, therefore the corrosion resistance was poor.

Comparative Examples 10 and 21 did not contain an aqueous acrylic resin having a high acid value and were therefore insufficient in point of the film formability. In these, the adhesiveness was poor and the appearance looked powdery.

In Comparative Examples 11 and 22, a different curing agent (carbodiimide) was used in place of the oxazoline group-containing polymer, but sufficient crosslinking could not be realized, and therefore in these, the waterproofness or the corrosion resistance was poor.

In Comparative Example 23, the Al content in the plated steel sheet was small and therefore, owing to overetching, the appearance looked powdery.

The invention claimed is:

1. A method for treating a surface of a zinc-aluminum-magnesium alloy-plated steel sheet with a metal surface treatment agent, the method comprising:

forming a zinc-aluminum-magnesium alloy-plating layer on a surface of a steel sheet, and subsequently treating a surface of the plating layer with the metal surface treatment agent, wherein the zinc-aluminum-magnesium alloy plating layer contains Al: 1.0 to 10 mass %, Mg: 1.0 to 10 mass %, and Zn, the metal surface treatment agent contains a compound (A) having a zirconyl ($[Zr{=}O]^{2+}$) structure, a vanadium compound (B), a titanium fluorocomplex compound (C), an organic phosphorus compound (Da) containing a phosphoric acid group and/or a phosphonic acid group, an inorganic phosphorus compound (Db), an aqueous acrylic resin (E), and an oxazoline group-containing polymer (F) as a curing agent, the aqueous acrylic resin (E) has an acid value of 300 mg KOH/g or more, a content of the aqueous acrylic resin (E), in terms of solid matter content contained therein, is 100 ppm to 30,000 ppm relative to a total content of the metal surface treatment agent, a content of the oxazoline group-containing polymer (F), in terms of solid matter content contained therein, is 50 ppm to 5,000 ppm relative to the total content of the metal surface treatment agent, and a ratio of a total mass of the compound (A) having a zirconyl ($[Zr{=}O]^{2+}$) structure, the vanadium compound (B), and the titanium fluorocomplex compound (C), in terms of metal elements contained therein, to a total mass of the aqueous acrylic resin (E) and the oxazoline group-containing polymer (F), in terms of solid matter contents contained therein, (A+B+C)/(E+F), ranges from 10/1 to 1/1, and the metal surface treatment agent has a pH of 3 to 6.

2. The method according to claim 1, wherein a mass ratio of the solid matter content of the aqueous acrylic resin (E) to the solid matter content of the oxazoline group-containing polymer (F), E/F, ranges from 20/1 to 2/3.

3. The method according to claim 1, wherein a mass ratio of the organic phosphorus compound (Da) to the inorganic phosphorus compound (Db), in terms of phosphorus element contained therein, Da/Db, ranges from 5/1 to 1/2.

4. The method according to claim 1, wherein the zinc-aluminum-magnesium alloy plating layer further contains one or more of Si: 0.001 to 2.0 mass %, Ti: 0.001 to 0.1 mass %, and B: 0.001 to 0.045 mass %.

5. A zinc-aluminum-magnesium alloy-plated steel sheet, obtained through the method of claim 1.

6. The method according to claim 1, wherein the metal surface treatment agent consists of the compound (A) having a zirconyl ($[Zr{=}O]^{2+}$) structure, the vanadium compound (B), the titanium fluorocomplex compound (C), the organic phosphorus compound (Da) containing a phosphoric acid group and/or a phosphonic acid group, the inorganic phosphorus compound (Db), the aqueous acrylic resin (E), and the oxazoline group-containing polymer (F).

* * * * *